United States Patent [19]

Collins et al.

[11] 3,948,404

[45] Apr. 6, 1976

[54] COMPOSITE PACKAGE FOR CONTAINING PRESSURIZED FLUIDS

[75] Inventors: Guy Hathaway Collins, Newark; Harlan Stuart Young, Wilmington, both of Del.

[73] Assignee: E. I. Du Pont de Nemours and Company, Wilmington, Del.

[22] Filed: Nov. 14, 1974

[21] Appl. No.: 523,711

[52] U.S. Cl. ..... 215/1 C; 215/12 R; 220/69

[51] Int. Cl.[2] ..... B65D 23/00

[58] Field of Search ..... 215/12 R, 1 C, 100.5; 220/66, 67, 68, 69, 70, 72; 222/184

[56] References Cited

UNITED STATES PATENTS

| | | | |
|---|---|---|---|
| 995,985 | 6/1911 | Perry | 215/12 R |
| 2,099,055 | 11/1937 | Ferngren | 215/1 C |
| 2,837,245 | 6/1958 | Grebowiec | 222/184 |
| 3,094,239 | 6/1963 | Baker | 220/66 |
| 3,107,028 | 10/1963 | De Robertis | 220/69 |
| 3,400,853 | 9/1968 | Jacobsen | 220/66 |
| 3,426,939 | 2/1969 | Young | 220/66 |
| 3,643,829 | 2/1972 | Lachner | 215/1 C |
| 3,722,725 | 3/1973 | Khetani et al. | 215/12 R |
| 3,726,429 | 4/1973 | Doughty | 215/1 C |
| 3,733,309 | 5/1973 | Wyeth et al. | 215/1 C |
| 3,757,978 | 9/1973 | Gilbert | 215/1 C |
| 3,870,181 | 3/1975 | Sincock | 215/1 C |

FOREIGN PATENTS OR APPLICATIONS

| | | | |
|---|---|---|---|
| 1,203,129 | 1/1960 | France | 220/69 |

*Primary Examiner*—William T. Dixson, Jr.
*Assistant Examiner*—Allan N. Shoap

[57] ABSTRACT

A composite package including a biaxially oriented polyethylene terephthalate bottle and a support cup. The bottom of the bottle has a degree of spherulitic crystallinity and is recessed to minimize exposure to shock which might cause rupture. Preferably, there is an interference fit between the bottle and support cup.

2 Claims, 3 Drawing Figures

COMPOSITE PACKAGE FOR CONTAINING PRESSURIZED FLUIDS

BACKGROUND OF THE INVENTION

This invention relates to a composite package for containing pressurized fluids and, more particularly, relates to a composite package having improved stability and eversion resistance.

Biaxially oriented thermoplastic bottles are receiving much attention as candidates to replace glass bottles presently being used to contain carbonated soft drinks, beer, aerosols, and the like. The attractiveness of thermoplastic bottles lies in their lower weight and general breakage resistance. On a per-pound basis, however, thermoplastics are more expensive than glass and it is necessary to minimize the weight of thermoplastic bottles if they are to be economically competitive with glass bottles. Consequently, the emphasis is to make thin-walled thermoplastic bottles.

Self-standing, thin-walled, thermoplastic bottles, when pressurized, experience severe forces which tend to cause the bottom to evert (i.e., assume a more hemispherical shape), causing the bottles to rock or tip over when placed on a flat surface. The art has suggested that the stability of such bottles can be improved by increasing the thickness of the bottle bottom, commonly in conjunction with use of an eversion-resistant bottom design, or by use of composite packages wherein a support ring or cup is attached to the bottle. In general, however, it is preferred to minimize bottle thickness and the more promising method for achieving stability is to employ a convex-bottom bottle with an inexpensive support cup.

Of the various thermoplastic materials, polyethylene terephthalate is regarded as one of the more promising candidates due to its high strength, impact resistance, and ability to hold liquids under pressure when biaxially oriented. Biaxially oriented polyethylene terephthalate bottles, however, tend to have an area of localized spherulitic crystallinity at their extreme bottom as explained hereinafter. This crystalline area is fragile, relative to other portions of the bottle, and may rupture when struck a sharp blow. For instance, the bottle may rupture if it lands on the crystalline area when dropped.

Polyethylene terephthalate has a marked tendency to crystallize when cooled from the molten state and it is extremely difficult, in a commercial process, to eliminate all traces of this crystallinity. Namely, when injection molded to form a bottle preform, an area of spherulitic crystallinity tends to form in portions of the preform which are adjacent to the mold gate. When such a closed end tubular preform is blow molded to form a bottle, the crystalline area is at the extreme bottom or nub of the closed end and is readily detectable due to its milky-white appearance.

Biaxially oriented bottles are readily made from these preforms using blow molding techniques well known in the art. In the finished bottles, the spherulitic crystallinity formed during preform manufacture is present at the extreme bottom (i.e., the nub) of the bottle. Thus, the bottom of polyethylene terephthalate bottles not only tends to evert under pressure, a problem common to thermoplastic bottles, but the nub is also particularly sensitive to rupture.

SUMMARY OF THE INVENTION

The present invention provides an improved composite package which improves the stability and breakage resistance of biaxially oriented polyethylene terephthalate bottles and includes:

1. a biaxially oriented, polyethylene terephthalate bottle having a generally convex base which merges into a concave central bottom region having a recessed nub, and
2. support means which engage and maintain the bottle in an upright position.

The bottle opening, neck finish, and sidewall portions are of any conventional design.

To minimize the weight of polymer used in making the bottle, the base is generally convex and has thinner walls than would be required if the bottle were to be self-standing, i.e., the base may have a thickness approaching, or equal to, the thickness of the bottle sidewalls. By "generally convex" is meant that the base has a rounded configuration, in a plane coincident with the longitudinal axis of the bottle, which can vary from hemispherical to shallow dish-shaped. A torispherical configuration is preferred because such a shape provides constant stress with a minimum constant thickness.

The central bottom portion of the bottle is concave to recess the nub into the base of the bottle, thereby reducing exposure of the nub to a sharp impact which could cause rupture. By "nub" is meant the extreme bottom of the bottle, corresponding to the gate region of the preform, which contains spherulitic crystallinity formed during injection molding of the preform. Since the base itself is biaxially oriented, the bottle is able to absorb an impact which might cause rupture if directed to the nub.

The bottle support means has a suitable design to engage the bottle and maintain it in an upright position and is constructed of plastic, paperboard, or other materials having sufficient strength for that purpose. For instance, a paperboard or plastic sleeve, or preferably a cup, can mechanically engage the bottle or can be secured to the bottle by an adhesive.

DETAILED DESCRIPTION OF PREFERRED EMBODIMENT

Figure 1:
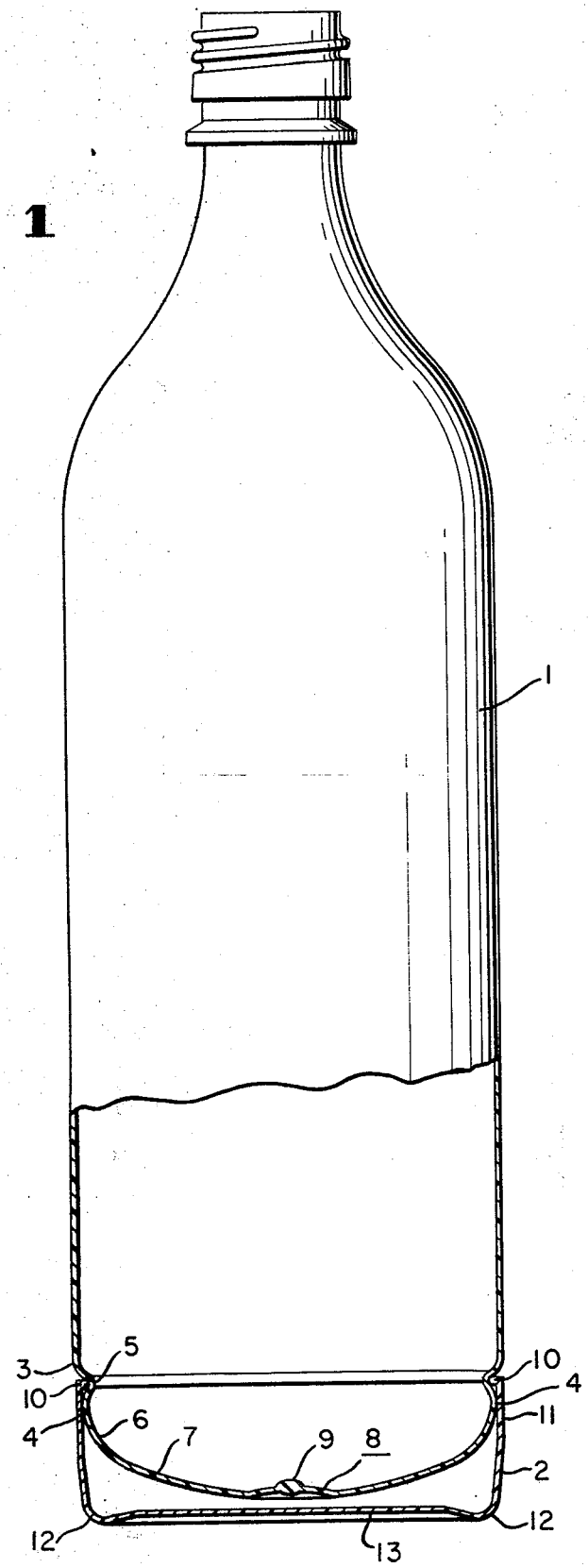
FIG. 1 is a elevational view, in partial section, of a preferred composite package.

Referring now to FIG. 1, the composite package includes a biaxially oriented, polyethylene terephthalate bottle, generally indicated as 1 and a shallow bottle support cup, generally indicated as 2. The upper section of the bottle has a conventional shape, and includes a dispensing opening, a suitable finish to accept a screw or crown cap, and an upper sidewall portion which flares outwardly to merge with a right cylinder sidewall portion which forms the major portion of the bottle. Other suitable designs of the upper bottle section can readily be selected.

At the bottom of the cylindrical section is a groove, formed by curved wall sections 3, 4 and 5, which groove extends around the periphery of the bottle. As shown in detail in FIG. 2, wall section 3 has a radius of curvature $R_3$ centered on the plane perpendicular to the bottle axis at the bottom of the cylindrical section to provide a smooth, tangential transition from the cylindrical section to the groove. Wall section 4 has a radius of curvature $R_4$ centered within the bottle to provide a transition from the groove to the base of the bottle, the radius and center of $R_4$ being selected such that the maximum outside diameter of the bottle along wall section 4 is less than the diameter of the cylindrical wall section but greater than the inside diameter of the base cup which comes in contact with wall section 4. Concave wall section 5 forms the bottom of the groove and provides a smooth transition between wall sections 3 and 4.

Figure 2:
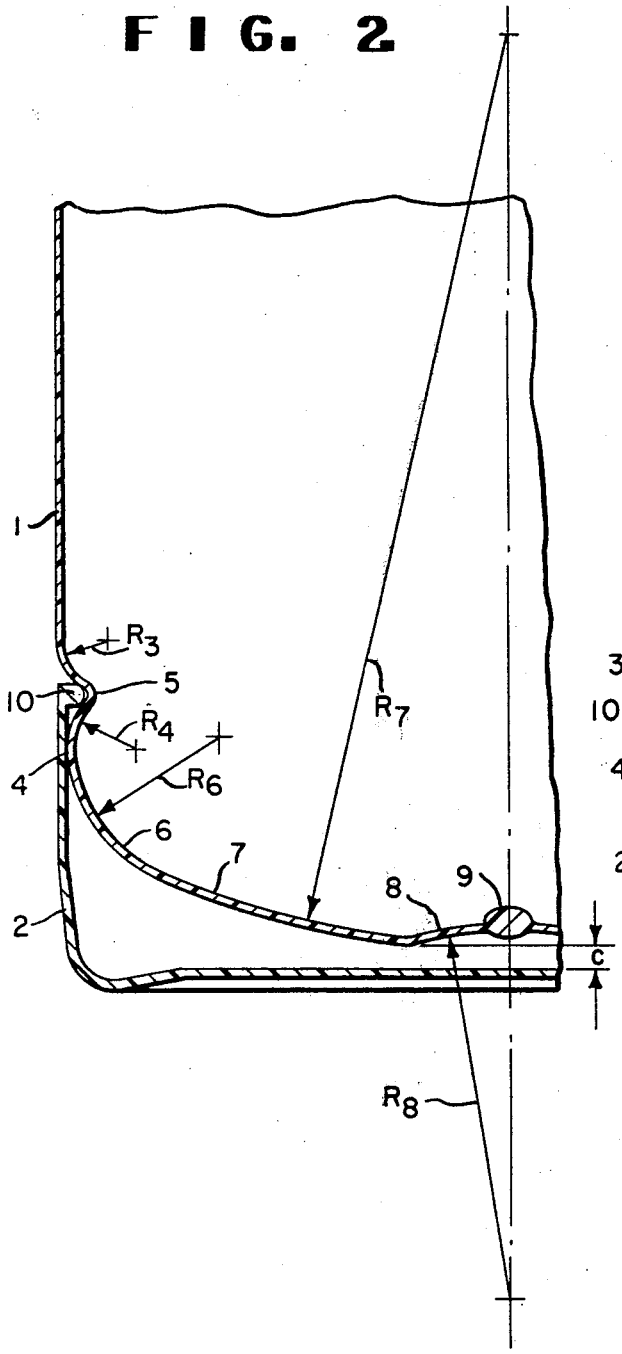
FIG. 2 is an enlarged cross section of a portion of the bottom of the bottle of FIG. 1.

The base of the bottle is generally convex and can be hemispherical if a relatively tall support cup is desired, or can be of parabolic or dish-shaped design if a shorter support cup is selected. FIGS. 1 and 2 illustrate a torispherical base, defined by wall sections 6 and 7, which is pressure resistant to minimize eversion of the base under pressure and which is preferred when using a short support cup. Wall section 6 has a radius $R_6$ located within the bottle which provides a smooth transition from wall section 4 to wall section 7. Wall section 7 has a radius $R_7$ centered on the bottle axis.

The central bottom region of the bottle, 8, including the nub 9, tends to contain spherulitic crystallinity and/or other structural weakness present in the gate region of an injection-molded polyethylene terephthalate bottle preform, and is concave to recess the structurally weak region within the base, thereby minimizing exposure to stresses which might cause rupture. By "recess" or "recessed" is meant that the central bottom region and nub will not contact a plane drawn perpendicular to the bottle axis at the lower extremity of the base.

Generally, the nub is thick, relative to the base wall and as shown in the drawings, since the corresponding gate-area of the preform is not significantly reduced in thickness during the bottle blow molding operation; i.e., a mandrel is generally employed to pin the gate-area of the preform against the mold bottom during blow molding, thereby centering the preform to achieve uniform wall thickness during blow molding. Although the base will tend to deflect outwardly toward a hemispherical configuration when pressurized, the relatively thick nub will not evert. Consequently, a very shallow recess can be employed. For instance, a central recessed area having a diameter of about 0.75 in. (19.2 mm.), perpendicular to the bottle axis, and a curvature radius $R_8$ of 1.2 in. (30.5 mm.) can be selected to advantage.

A preferred base cup, also known as a "support cup" has an upper sidewall portion 11 having an outside diameter approximately that of the cylindrical bottle sidewall to provide a smooth, attractive transition from the bottle to the base cup. The upper edge of the base cup has an integral bead 10 which serves as a snap ring to engage the groove provided on the bottle, securing the bottle and base cup to form a composite package.

The base cup sidewalls flare inwardly and merge into toroidal knuckle 12, which serves as a standing ring for the package. The bottom 13 of the base cup is a recessed disc which further isolates the crystalline recessed bottom region of the bottle from external stresses. Prior to the bottle being filled, a clearance gap C, 0.1 inch for example, is present between the lower extremity of the bottle and the recessed base cup disc, as shown in FIG. 2.

It has been mentioned that the extreme outer diameter of bottle wall section 4 is greater than the inside diameter of support cup sidewall section 11 prior to assembly of the package. Conveniently, the support cup is made of an inexpensive material such as high-density polyethylene which deflects outwardly as the support cup is forced over bottle wall section 4 and has sufficient resiliency to contract toward its initial shape as the snap ring engages the bottle groove, thereby engaging the bottle in an interference fit. Alternatively, a more rigid material can be selected for the base cup and, since biaxially oriented polyethylene terephthalate has a degree of resiliency, bottle wall 4 will deflect inwardly during assembly of the composite package and again engage the cup in an interference fit.

Figure 3:
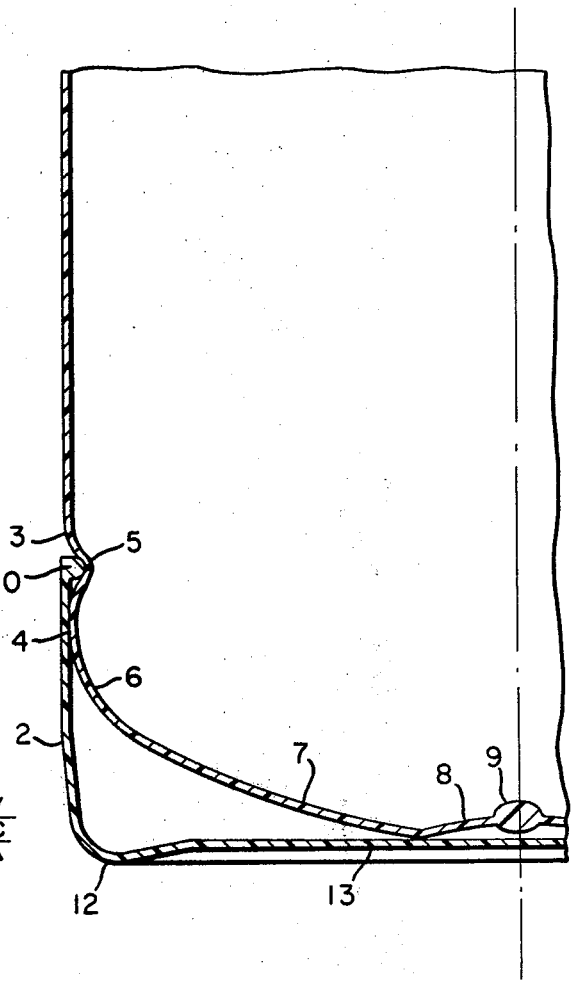
FIG. 3 is similar to FIG. 2 and shows deflection when the bottle contains a pressurized fluid.

When the package is filled with a pressurized fluid, the groove and bottle wall sections 4 and 5 deflect outwardly, as shown in FIG. 3, the groove becomes less defined, and the base assumes a more hemispherical configuration, resulting in an increased interference fit between the support cup and wall section 4 of the bottle.

In a typical package used to contain carbonated soft drinks, a 32-oz. bottle has a 3.15-in. O.D. (80.0 mm.) in the cylindrical sidewall portion, $R_3$ is 0.18 in. (4.58 mm.), $R_4$ is 0.225 in. (5.72 mm.), the bottom of the groove has a 0.025-in. (0.635 mm.) radius of curvature, $R_6$ is 0.50 in. (12.7 mm.), $R_7$ is 3.0 in. (76.2 mm.), $R_8$ is 1.2 in. (30.5 mm.) and clearance C is 0.10 in. (2.54 mm.). The maximum outside diameter in wall section 4 is 3.06 in. (77.8 mm.). The wall thickness typically varies from 20 mils (0.508 mm.) in the cylindrical sidewall section, to 25 to 30 mils (0.635 to 0.762 mm.) in the groove area, to 100 to 150 mils (2.54 to 3.82 mm.) in the base, with the nub being about 0.2 in. (5.08 mm.) thick. A typical support cup has a height of 1.11 in. (28.2 mm.) and a thickness of 30 mils (0.762 mm.).

We claim:

1. A composite package for containing carbonated soft drinks, beer, or aerosols comprising:
   a. a biaxially oriented, polyethylene terephthalate bottle having a generally convex base merging into an inwardly recessed concave relatively crystalline central bottom region having a nub, said nub being centrally located and thick relative to the entire bottom wall and
   b. support means engaging and maintaining said bottle in an upright position.

2. The package of claim 1 wherein said bottle is formed from a closed-end, injection-molded preform.

* * * * *